US009268269B2

(12) United States Patent
Sekiya

(10) Patent No.: US 9,268,269 B2
(45) Date of Patent: Feb. 23, 2016

(54) IMAGE HEATING APPARATUS HAVING MOTOR FOR MOVING SHUTTER OR MAGNETIC FLUX CONFINING MEMBER

(71) Applicant: CANON KABUSHIKI KAISHA, Tokyo (JP)

(72) Inventor: Takeshi Sekiya, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/628,677

(22) Filed: Feb. 23, 2015

(65) Prior Publication Data

US 2015/0241824 A1 Aug. 27, 2015

(30) Foreign Application Priority Data

Feb. 24, 2014 (JP) ..... 2014-033342

(51) Int. Cl.
*G03G 15/20* (2006.01)
*G03G 21/20* (2006.01)

(52) U.S. Cl.
CPC ..... *G03G 15/2039* (2013.01); *G03G 15/2017* (2013.01); *G03G 15/2042* (2013.01); *G03G 21/206* (2013.01)

(58) Field of Classification Search
CPC ..... G03G 15/2017; G03G 15/2042; G03G 15/2046; G03G 15/2082; G03G 21/206
USPC ..... 399/33, 334; 219/216
See application file for complete search history.

(56) References Cited

U.S. PATENT DOCUMENTS

| | | | | |
|---|---|---|---|---|
| 7,764,895 | B2 * | 7/2010 | Tomine | G03G 15/2017 399/328 |
| 9,025,989 | B2 * | 5/2015 | Murasaki | G03G 15/2017 399/92 |
| 9,081,340 | B2 * | 7/2015 | Suzuki | G03G 15/2042 |
| 2014/0270831 | A1 * | 9/2014 | Yoshinaga | G03G 15/2039 399/67 |
| 2015/0177657 | A1 * | 6/2015 | Akiya | G03G 21/206 399/69 |

FOREIGN PATENT DOCUMENTS

| | | | |
|---|---|---|---|
| JP | 62-264082 | A | * 11/1987 |
| JP | 04-51179 | A | 2/1992 |
| JP | 2006-195102 | A | * 7/2006 |
| JP | 2008-014986 | A | * 1/2008 |
| JP | 2008-089986 | A | * 4/2008 |

* cited by examiner

*Primary Examiner* — Robert Beatty
(74) *Attorney, Agent, or Firm* — Fitzpatrick, Cella, Harper & Scinto

(57) ABSTRACT

An image heating apparatus includes a heating member for heating a toner image on a sheet; a fan; a duct provided with an opening for discharging air supplied by the fan, toward the heating member; a shutter for the opening; a motor for moving the shutter; a detector for detecting that the shutter is in a predetermined position; and a controller for controlling the motor; wherein when the detector does not detect the shutter after a predetermined time elapses from production of first instruction for moving the shutter toward the predetermined position, the controller produces second instruction for moving the shutter in a direction away from the predetermined position.

36 Claims, 9 Drawing Sheets

| SHEET SIZES | A3/A4 | LDR/LTR | B4/B5 | LTR-R | A4R/A5 |
|---|---|---|---|---|---|
| PULS NO. | 16 | 51 | 96 | 178 | 190 |
FIG. 5
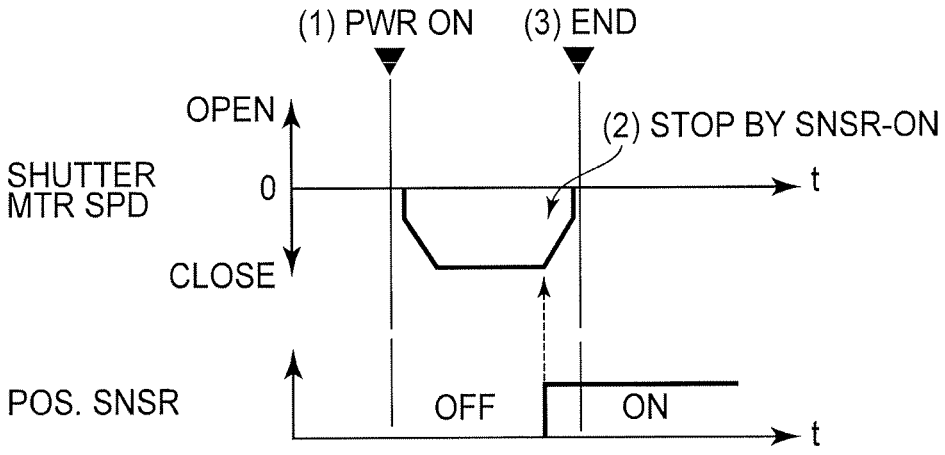
FIG. 6A
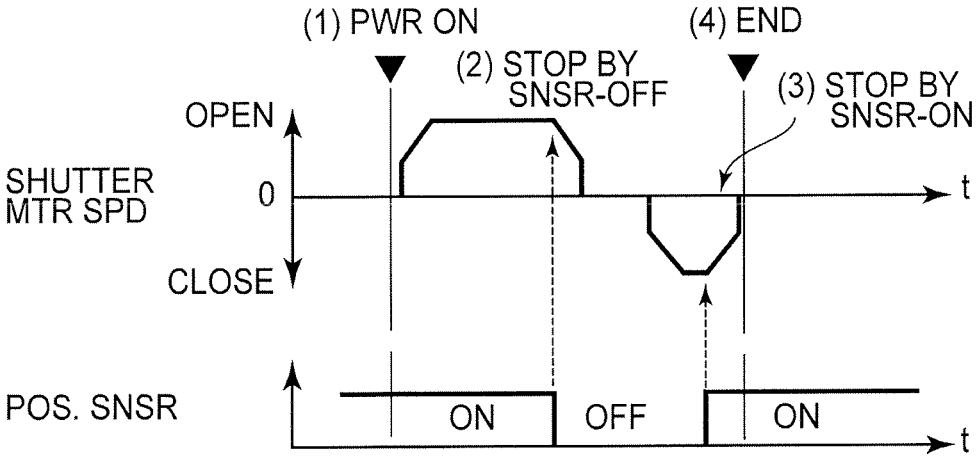
FIG. 6B

IMAGE HEATING APPARATUS HAVING MOTOR FOR MOVING SHUTTER OR MAGNETIC FLUX CONFINING MEMBER

FIELD OF THE INVENTION AND RELATED ART

The present invention relates to an image heating apparatus (device) for heating a toner image on a sheet of a recording medium. An image heating apparatus is employed by an image forming apparatus such as a copying machine, a printer, a facsimile machine, and also, a multifunction machine capable of performing the functions of two or more of the preceding examples of an image forming apparatus.

Conventionally, a fixing device (image heating device) installed in an electrophotographic image forming apparatus is structured to use its fixing member (heating member) to fix a toner image formed on a sheet of a recording medium.

When a fixing device such as the above-mentioned one is used for image fixation, the portion of its fixing member, which comes into contact with a sheet of the recording medium (these portions hereafter will be referred to as contact portions) is robbed of heat, whereas the portion of its fixing member, which does not come into contact with a sheet of the recording medium (this portion hereafter will be referred to as the noncontact portion) is not robbed of heat by a sheet of the recording medium.

Therefore, the fixing member has to be replenished with heat to keep its contact portion stable in temperature at a preset level. Thus, it is possible that the noncontact portion of the fixing member will increase in temperature above the preset level and this increase will not be able to be ignored. This phenomenon will possibly occur when a toner image is fixed to a sheet of the recording medium which is less in dimension than a fixing member, in terms of the direction which is perpendicular to the recording medium conveyance direction (this direction will be referred to as the "widthwise direction", hereafter).

Thus, in the case of the fixing device disclosed in Japanese Laid-open Patent Application H04-51179, it is structured so that air is blown at the noncontact portions of the fixing member (part of end portions in terms of the widthwise direction) through air ducts, to selectively cool these portions.

Also, in the case of the fixing device disclosed in Japanese Laid-open Patent Application H04-51179, it is structured so that the air outlet of each air duct can be adjusted in width by a shutter to accommodate various sheets of a recording medium which are different in width.

However, a fixing device structured like the one disclosed in Japanese Laid-open Patent Application H04-51179 will possibly suffer from the following problem.

That is, the mechanism for moving the shutters will suddenly fail to operate for some reasons, although the occurrence of such a problem will be extremely rare. For example, it is possible that foreign objects will enter the mechanism for moving the shutters, and get stuck therein, thereby causing the mechanism to malfunction.

Conventionally, when a situation such as the above-described one occurred, a user was informed of the malfunction (error, abnormality), and the fixing device was disabled, that is, the image forming apparatus was kept completely disabled, until the fixing device was repaired, regardless of the causes of the malfunction. In other words, the fixing device had to be repaired by a service person. That is, a user could not use the device until it was repaired.

In other words, even if the image forming apparatus is suffering from an anomaly from which it may be capable of quickly recovering, it is automatically shut down, thereby frustrating the user. Thus, the user satisfaction in using an image forming apparatus designed to deal with an anomaly in the above-described manner is relatively low.

By the way, a fixing device which employs a heating system based on electromagnetic induction, and a shutter (magnetic flux blocking member) to control the unwanted temperature increase across the noncontact portions of its fixing member, also suffers from a problem similar to the above described one.

SUMMARY OF THE INVENTION

According to an aspect of the present invention, there is provided an image heating apparatus comprising a heating member for heating a toner image on a recording material; a fan; a duct provided with an opening for discharging air supplied by the fan, toward the heating member; a shutter for opening and closing the opening; a motor for moving the shutter; a detector for detecting that the shutter is in a predetermined position; and a controller for controlling an operation of the motor. When the detector does not detect the shutter after a predetermined time elapses from the production of first instructions for moving the shutter toward the predetermined position, the controller produces second instructions for moving the shutter in a direction away from the predetermined position.

Further features of the present invention will become apparent from the following description of exemplary embodiments with reference to the attached drawings.

BRIEF DESCRIPTION OF THE DRAWINGS

FIG. 5 is a table which shows the relationship between the recording medium dimension in terms of the widthwise direction, and the number of pulses for driving the shutter moving motor.

FIGS. 6A and 6B are timing charts of the initial check sequence.

FIG. 10C is a schematic perspective view of the shutter.

DESCRIPTION OF THE PREFERRED EMBODIMENTS

Hereinafter, an image heating apparatus (device) which is in accordance with the present invention is described in detail with reference to appended drawings. By the way, hereafter, the structures of the image forming apparatuses in the preferred embodiments of the present invention are concretely described. However, these embodiments are not intended to limit the present invention in scope in terms of structure. That is, it is needless to say that the present invention is also applicable to various apparatuses different in structure from those in the following embodiments, within a gist of the scope of the present invention.

Embodiment 1

Figure 1:
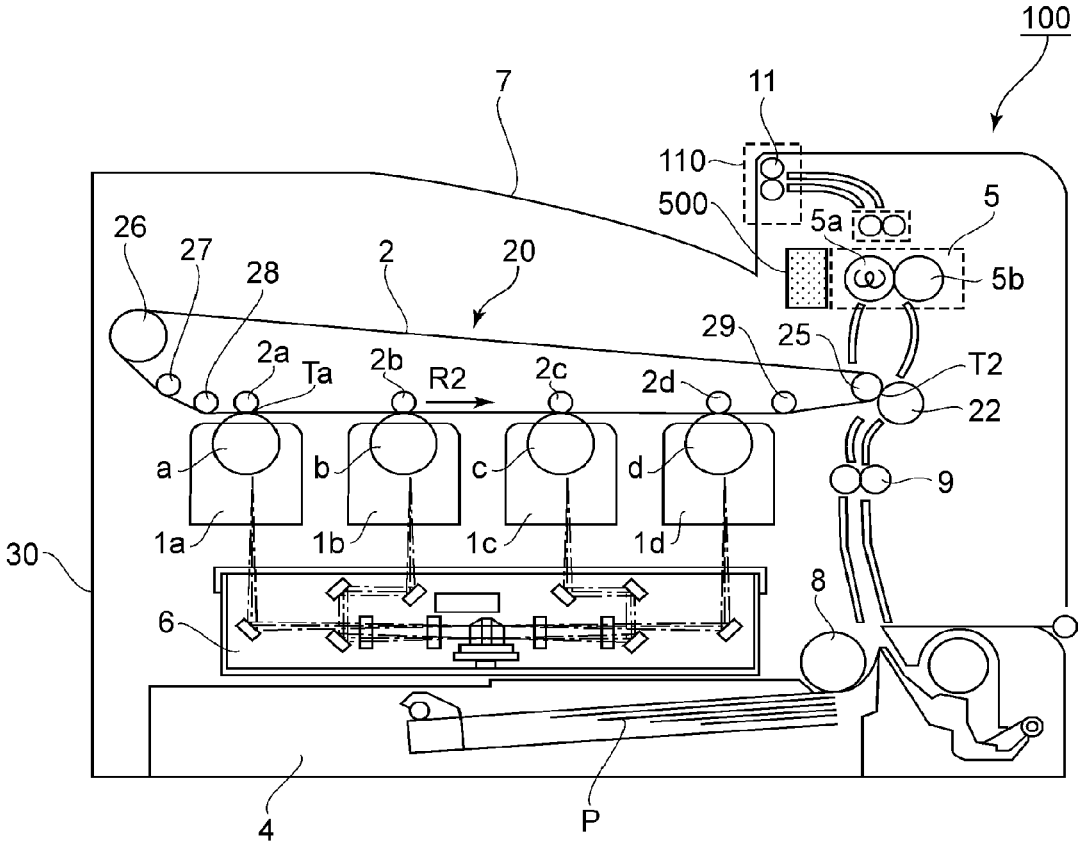
FIG. 1 is a sectional view of a typical image forming apparatus to which the present invention is applicable, and shows the general structure of the apparatus.

FIG. 1 is a schematic sectional view of the image forming apparatus, in this embodiment, which has a fixing device as an image heating device. It shows the general structure of the apparatus.

First, the image forming section of the image forming apparatus is described, and then, the fixing device of the apparatus is described.

(Image Forming Section)

Referring to FIG. 1, the image forming apparatus 100 is a full-color copying machine. It has four image forming sections 1*a*, 1*b*, 1*c* and 1*d*, which are aligned in tandem along the bottom surface of the intermediary transfer belt 2.

A separation roller 8 pulls the sheets P in the recording medium cassette 4, out of the cassette 4, while separating the sheets P one by one. Then, it sends each sheet P to a pair of registration rollers 9, which catch the sheet P and keep the sheet P on standby, while remaining stationary. Then, the registration rollers 9 send the sheet P to the secondary transferring section T2, with such a timing that the sheet P arrives at the secondary transferring section T2 at the same time as the toner image on the intermediary transfer belt 2.

The image forming sections 1*a*, 1*b*, 1*c*, and 1*d* are roughly the same in structure, although they are different in the color (yellow, magenta, cyan and black, respectively) of the toner (normal polarity to which toner is charged is negative) used by their developing device. Therefore, only the image forming section 1*a* is described. The description of the other image forming sections 1*b*, 1*c* and 1*d* is the same as that of the image forming section 1*a*, except for the suffixes b, c and d, of their reference characters, which indicate the color of the toner.

The image forming unit 1*a* is in the form of a replaceable unit (process cartridge) which includes a photosensitive drum a.

The photosensitive drum a is made up of an aluminum cylinder, and a photosensitive layer formed on the peripheral surface of the aluminum cylinder. The normal polarity to which the photosensitive drum a is chargeable is negative. As a driving force is transmitted to the photosensitive drum a from an unshown drum driving motor, the photosensitive drum a rotates at a preset process speed (200 mm/sec in this embodiment).

The photosensitive drum a is uniformly charged to the negative polarity by an unshown charge roller in the image forming section 1*a*.

The exposing device 6 forms an electrostatic image on the peripheral surface of the charged peripheral surface of the photosensitive drum a, by scanning, with the use of a rotational mirror, the charged peripheral surface of the photosensitive drum a, with a beam of laser light which it projects while modulating the beam with the signals for forming a yellow monochromatic image obtained by separating the image to be formed, into primary colors. The electrostatic image written on the peripheral surface of the photosensitive drum a is developed in reverse by an unshown developing device in the image forming section 1*a*; toner is adhered to the exposed points on the peripheral surface of the photosensitive drum a.

The primary transfer roller 2*a* presses the intermediary transfer belt 2, forming thereby the primary transferring section Ta between the photosensitive drum 1*a* and intermediary transfer belt 2. As positive DC voltage is applied to the primary transfer roller 2*a*, the negatively charged toner image on the photosensitive drum a is transferred (primary transfer) onto the intermediary transfer belt 2 while the intermediary transfer belt is conveyed through the primary transferring section Ta.

An intermediary transfer unit 20 is positioned above a combination of the image forming sections 1*a*, 1*b*, 1*c* and 1*d*. It is a replaceable unit; it is installed into, or uninstalled from, the image forming apparatus 100. It has the intermediary transfer belt 2, a mechanism for supporting the intermediary transfer belt 2, and a driving mechanism for driving the intermediary transfer belt 2.

The intermediary transfer belt 2 is an endless belt. It is supported and kept tensioned, by a tension roller 27, a driving roller 26, a secondary transfer roller 25, primary transfer/tension rollers 28 and 29, in a manner to bridge the adjacent rollers. It is rotationally driven by the driving roller 26 in the direction indicated by an arrow mark R2.

The intermediary transfer unit 20 has primary transfer rollers 2*a*, 2*b*, 2*c* and 2*d*, which correspond to the image forming sections 1*a*, 1*b*, 1*c* and 1*d*, respectively. The primary transfer rollers 2*a*, 2*b*, 2*c* and 2*d* form the secondary transferring sections by causing the intermediary transfer belt 2 to contact the photosensitive drum 1*a*, 1*b*, 1*c* and 1*d*, respectively, by being pressed toward the photosensitive drums, a, b, c and d, respectively.

The secondary transferring section T2 is formed by causing the secondary transfer/tension roller 25 and the secondary transfer roller 22 to sandwich the intermediary transfer belt 2. The secondary transfer-tension roller 25 belongs to the intermediary transfer unit 20, whereas the secondary transfer roller 22 is apart of the main assembly of the image forming apparatus 100. As positive DC voltage is applied to the secondary transfer roller 22 from an unshown electric power source, a transfer electric field is formed between the secondary transfer roller 22 and the secondary transfer-tension roller 25, which is grounded.

After the fixation of the toner image to the sheet P of the recording medium by the fixing device 5, which will be described later, the sheet P is discharged out of the image forming apparatus 100.

(Image Formation Sequence)

Next, the image formation sequence (which hereafter may be referred to as image forming operation) of the above-described image forming apparatus is described.

A control unit, which will be described later in detail, has a CPU for controlling the operation of the mechanism of each of the above-described units. It has also a motor driver, etc.

As an image forming operation start signal is outputted by the CPU, an operation for feeding sheets P of the recording medium in a desired recording medium cassette 4 into the main assembly of the image forming apparatus 100, and conveying further, is started by the separation roller 8.

More concretely, referring to FIG. 1, first, sheets P are moved out one by one by one from the recording medium cassette 4 by the separation roller 8. Then, each sheet P is conveyed to the pair of registration rollers 9. During this operational sequence, the registration rollers 9 are kept on standby. Therefore, the leading edge of the sheet P collides with the nip which is between the two registration rollers 9. Then, the registration rollers 9 begin to be rotated with the same timing as the timing with which the image forming sections 1*a*-1*d* begin to form an image. This timing is set so that the arrival of the toner images transferred onto the intermediary transfer belt 2 by the image forming sections 1*a*-1*d*, at the secondary transfer section T2 coincides with the arrival of the sheet P of the recording medium at the secondary transferring section T2.

Meanwhile, in the image forming sections 1*a*-1*d*, the toner image formed on the photosensitive drum a (which is in the most upstream image forming section in terms of the rotational direction of the intermediary transfer belt 2) through the above-described process, in response to the image formation start signal, is transferred (primary transfer) onto the intermediary transfer belt 2, in the primary transfer section Ta. After the primary transfer of the toner image onto the intermediary transfer belt 2, the toner image is conveyed to the next primary transfer section Tb of the image forming section 1*b* in which an image is being formed with such a timing that is delayed by the length of time it takes for a toner image to be conveyed from one image forming station to the next one. Thus, the toner image formed in the image forming section 1*b* is transferred onto the intermediary transfer belt 2 in such a manner that it is layered upon the toner image (formed in image forming section 1*a*) on the intermediary transfer belt 51. An image forming operation is carried out also in the image forming sections 1*c* and 1*d* with a timing which is similar to the above-described one. Thus, four monochromatic images, different in color, are transferred (primary transfer) onto the intermediary transfer belt 2.

Then, as the sheet P of the recording medium enters the secondary transferring section T2, and comes into contact with the intermediary transfer belt 2, high voltage begins to be applied to the secondary transfer roller 22 with the same timing as the timing with which the sheet P is conveyed through the secondary transferring section T2. Thus, the four monochromatic toner images, different in color, formed on the intermediary transfer belt 2 through the above-described process, are transferred onto the surface of the sheet P. Thereafter, the sheet P is accurately guided to the nip of the fixing device 5.

In the fixing device 5, the sheet P of the recording medium is conveyed through the nip in the fixing device 5, remaining pinched by the nip 5*a*. While the sheet P is conveyed through the nip, the toner images on the sheet P are fixed to the surface of the sheet P by heat and pressure. The fixing device 5 is provided with a cooling unit 500, which is activated to prevent the end portions (noncontact portions; portions which do not contact sheet P when sheet P is smaller in widthwise dimension than fixation roller 5*a*) from excessively increasing in temperature. Whether or not the cooling unit 500 is to be activated is dependent upon the conditions under which the image forming apparatus 100 (fixing device 5) is operated.

After being moved out of the fixing device 5, the sheet P of the recording medium is conveyed further, and is discharged into the delivery tray 7 by the pair of discharge rollers 11 in such a manner that it will be layered upon the sheets P in the tray 7.

(Controlling Device)

Figure 2:
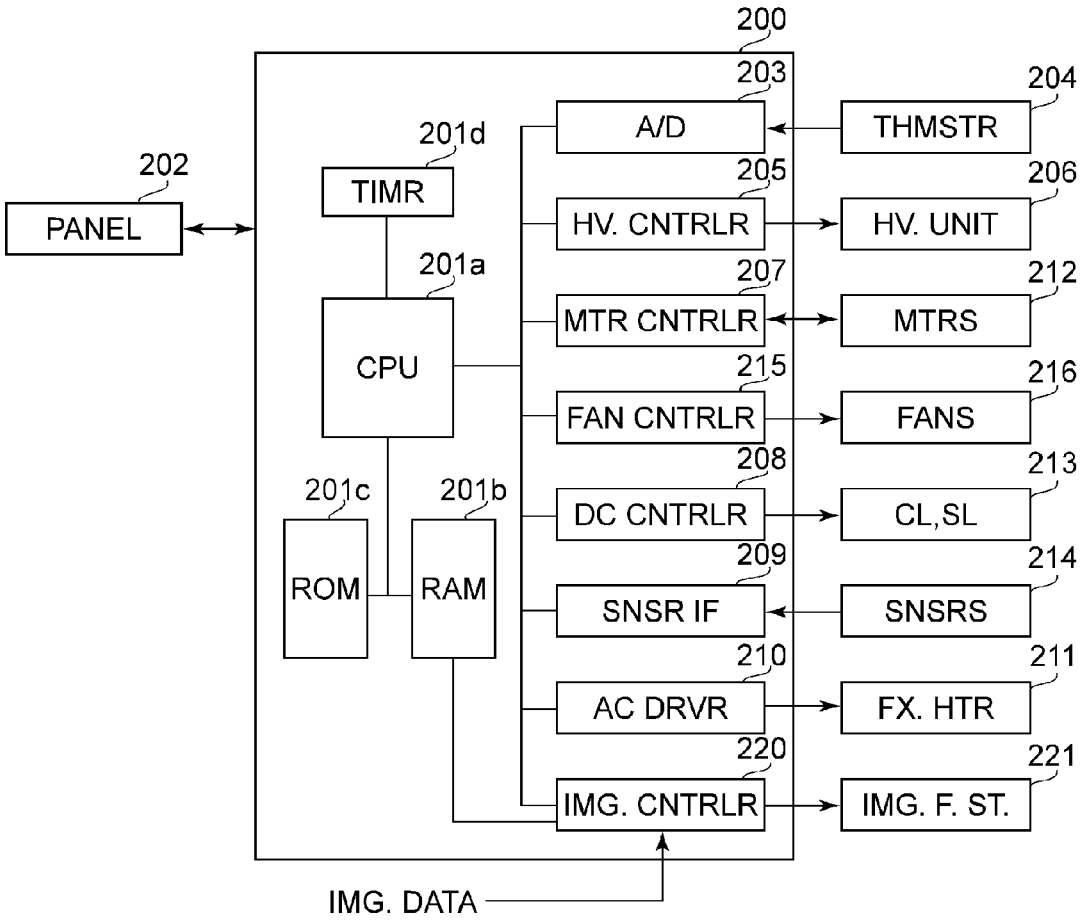
FIG. 2 is a block diagram of the control unit of the image forming apparatus shown in FIG. 1.

Next, the control unit 200, which is a controlling device, is described with reference to FIG. 2 which is a block diagram of the control unit 200.

Each of various devices in the image forming apparatus 100 is controlled by the control unit 200 in coordination with other devices in the apparatus 100. The control unit 200 functions as a controlling section (controller). The control unit 200 outputs to each of the various devices, commands to make the device to perform its operation, that is, signals for causing the device to perform its operation.

The control unit 200 bears the roles of driving each of various devices (loads) in the main assembly of the image forming apparatus 100, while collecting and analyzing the information from various sensors, controlling the image forming operation, and exchanging data with a user through the control panel 202, that is, the user interface. Regarding the internal structure of the control unit 200, the control unit 200 has a CPU 201*a* to bear the above-described roles. This CPU 201*a* carries out various sequences related to various preset image formation sequences, based on the programs stored in a ROM 201*c* mounted in the control unit 200, like the CPU 201*a*. The control unit 200 is also provided with a RAM 201*b*, in which re-writable data, which need to be temporarily or permanently stored, is stored. It is also in the RAM 201*b* that the values to be set for the high voltage controlling section 205, for example, various data which will be described later, information regarding the image formation commands inputted or outputted through the control panel 202, etc., are stored. The image forming apparatus 100 is structured so that the data are retained in the RAM 201*b* by a battery or the like power source, even if the primary power source of the image forming apparatus 100 is turned off. Further, the CPU 201*a* is connected to a timer 201*d*. Not only does the CPU 201*a* control the operation of the timer 201*d*, but also, it monitors the length of time measured by the timer 201*d*.

The control panel 202 functions as an information disseminating section. It can also be used by a user to input information such as the recording medium size, the recording medium type (cardstock, coatedpaper, etc.), the print count, the copy magnification, the image density, etc., which are necessary for image formation. The control panel 202 is provided with a monitor section (liquid crystal display). Therefore, it can also be used to inform a user of "anomalies (errors)" which occurred to the image forming apparatus 100. For example, it can display a sentence such as "fixing device is abnormal in operation" to provide a user with a written error message. Further, it can display such information as whether or not the image forming apparatus 100 is in the middle of image formation, whether or not a paper jam has occurred, where is the location of the paper jam, and the like.

The main assembly of this image forming apparatus 100 contains DC loads, such as motors, fans, clutches/solenoids, etc. It contains also sensors such as photo-interrupters, microswitches, etc. The control unit 200 causes the image forming apparatus 100 to carry out such operation as conveying sheets P of the recording medium, driving each of the various units, etc., by driving an AC motor, and the other DC loads, as necessary. It is each of the various sensors that are used to monitor the operation of each of the various units.

The control unit 200 controls each of various motors 212, based on the signals from the various sensors 214, with the use of a motor control section 207, while making the image forming apparatus 100 smoothly carry out an image forming operation by activating clutches/solenoids 213 with the use of a DC load control section 208, and also, activating various fans with the use of a fan control section 208. Further, the control unit 200 creates various high voltage control signals, and outputs the signals to the high voltage unit 206 from the high voltage controlling section 205. The high voltage unit 206 applies proper voltages to the various charging devices, and more specifically, a primary charging device, a transfer charging device, and a development roller in the developing device. The fixation heater 211 for heating the fixation roller 5*a* is turned on or off by an AC driver 210. Further, there is provided a thermistor 304 for detecting the temperature of the fixation heater 211. The changes, which occur to the electrical resistance of the thermistor in response to the changes in the temperature of the fixation roller 5*a*, are converted by an A/D 203 into digital values, which are inputted into the control unit 200. It is based on these temperature data that the above-described AC driver 210 is controlled.

Further, the image controlling section 220 processes the externally inputted image formation data, and sends the processed data to the image forming section 221.

(Fixing Device)

Figure 3:
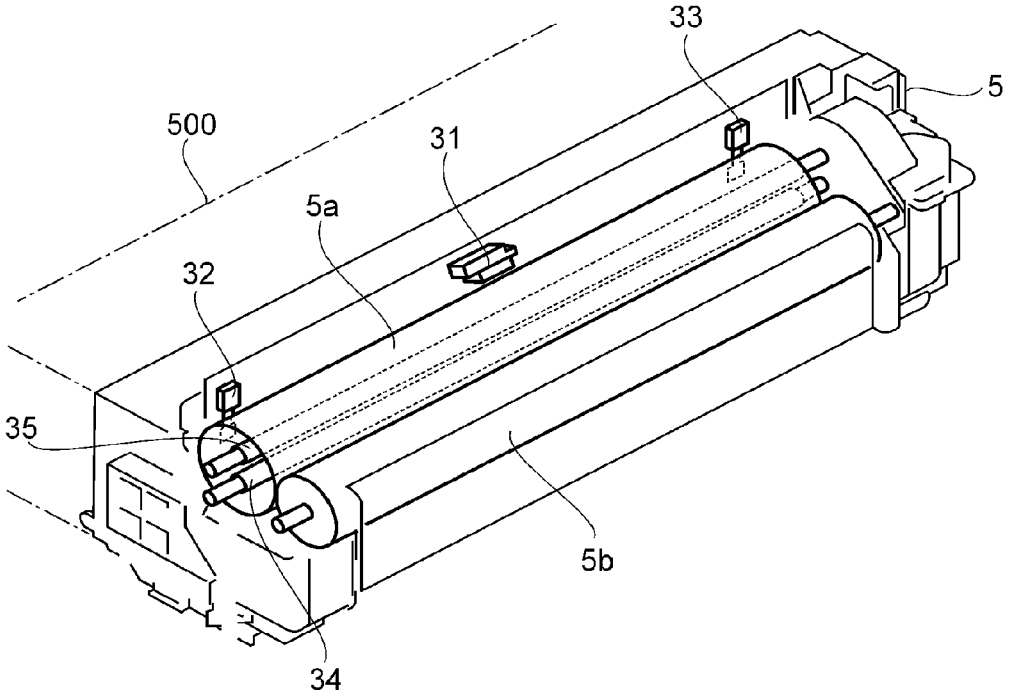
FIG. 3 is a perspective view of the fixation unit of the image forming apparatus.

Next, referring to FIG. 3, the fixing device 5, which functions as an image heating device, is described. FIG. 3 is a perspective view of the fixing device 5.

The fixing device 5 has: the fixation roller 5*a* which is a rotational heating member (heating member); and a pressure roller 5*b* which is a heat applying rotational member. There is formed a nip between the two rollers 5*a* and 5*b*. A sheet P of the recording medium is subjected to heat and pressure while it is conveyed through the nip, remaining pinched by the fixation roller 5*a* and pressure roller 5*b*. Consequently, the toner image on the sheet P is fixed to the sheet P.

There are two heaters 34 and 35, as parts of the heating system, in the hollow of the fixation roller 5*a*. The fixation roller 5*a* is heated by these heaters 34 and 35. The fixing device 5 is also provided with a main thermistor 31, a sub-thermistor 32, and a sub-thermistor 33, which are temperature sensors and are positioned in the immediate adjacencies of the peripheral surface of the fixation roller 5*a*. In terms of the lengthwise direction of the fixation roller 5*a*, the main thermistor 31 is positioned at roughly the center of the fixation roller 5*a*. The sub-thermistors 32 and 33 are positioned near the lengthwise ends, one for one, of the fixation roller 5*a*. The control unit 200 controls the temperature of the contact portion of the fixation roller 5*a* (portion which contacts sheet P regardless of sheet size) by controlling the amount of electric power supplied to the heaters 34 and 35, in response to the output of the thermistor 31. Further, the provision of the thermistors 32 and 33 makes it possible to check the temperature distribution of the peripheral surface of the fixation roller 5*a* in terms of the lengthwise direction (which is parallel to the recording medium conveyance direction) of the fixation roller 5*a*, that is, the temperature of the noncontact portions of the fixation roller 5*a*. Therefore, these thermistors 32 and 33 are used to prevent the temperature of the noncontact portions of the fixation roller 5*a* from excessively increasing. Further, the provision of the thermistors 31, 32, and 33 makes it possible to detect an anomaly in the heaters 34 and 35.

(Cooling Device)

Next, the cooling device (which hereafter will be referred to as cooling unit) for cooling the fixing device 5 will be described.

Figure 4:
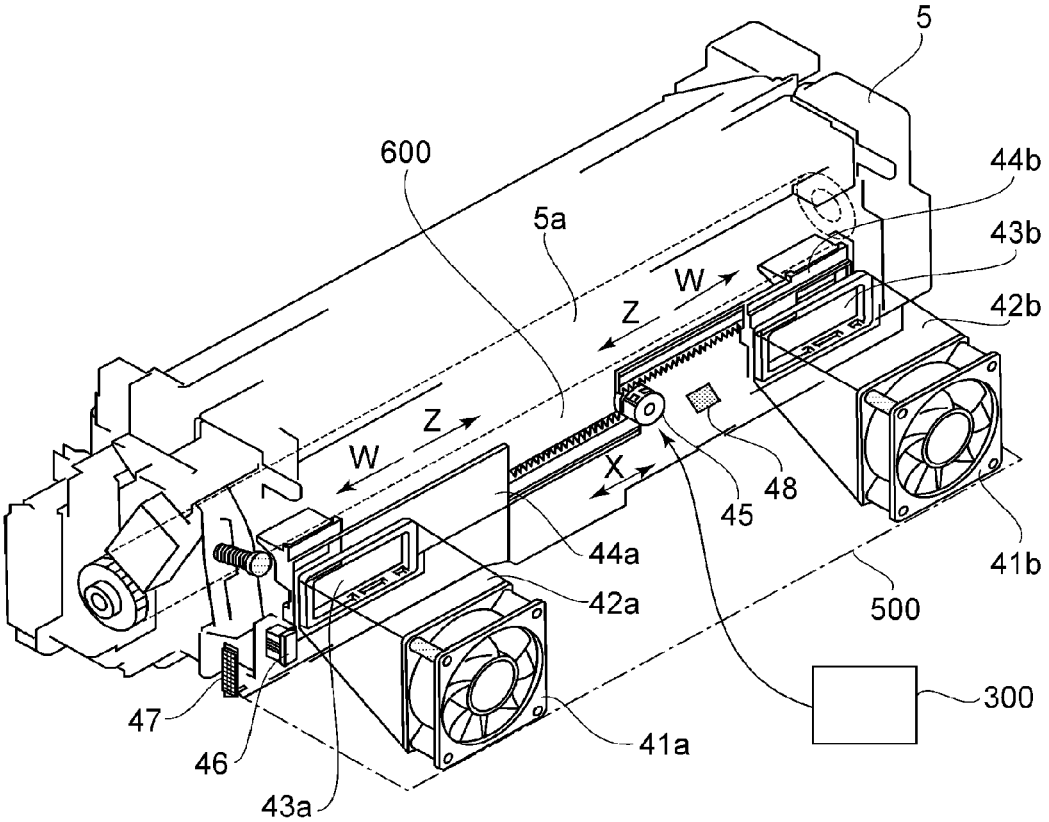
FIG. 4 is a perspective view of the cooling unit of the image forming apparatus.

FIG. 4 is a perspective rear view of the cooling unit 500.

The cooling unit 500 is positioned in the immediate adjacencies of the fixing device 5. It is activated when a toner image formed on a sheet $P_{small}$ of the recording medium, whose widthwise dimension is smaller than that of the largest sheet $P_{max}$ of the recording medium usable by the image forming apparatus 100, is fixed, in order to blow air at the portions of the fixation roller 5*a*, which do not come into contact with the sheet P (which hereafter may be referred to as "noncontact portions" or "out-of-sheet-path portions") to selectively cool the noncontact portions to prevent the noncontact portions from excessively increasing in temperature.

The cooling unit 500 has a pair of cooling fans 41*a* and 41*b*, a pair of air ducts 42*a* and 42*b*, a pair of air outlets 43*a* and 43*b*, and a pair of shutters 44*a* and 44*b* as controlling members. Further, the cooling unit 500 has: a mechanism 600 for moving the shutters 44*a* and 44*b*; a motor 300 for driving the shutter moving mechanism 600; a home position sensor 43; and a pair of stoppers 47 and 48. The shutter moving mechanism 600 is made up of a combination of a pair of racks and a pinion gear.

As the surface temperature of the fixation roller 5*a*, which is detected by the sub-thermistors 32 and 33, exceeds a preset level (240 degrees in this embodiment), the cooling fans 41*a* and 41*b* are turned on in response to the command (signal for making cooling fans 41*a* and 41*b* operate). The cooling wind generated by the cooling fans 41*a* and 41*b* are blown at parts of the lengthwise ends portions of the fixation roller 5*a* through the air outlets 43*a* and 43*b*, respectively.

The rotational speed of the cooling fans 41*a* and 41*b* can be changed by the control unit 200 in response to the output of the sub-thermistors 32 and 33.

Referring to FIG. 4, the cooling unit 500 is structured so that the shutters 44*a* and 44*b* can be slid (in direction X in FIG. 4) by the mechanism 600 made up of a pair of racks and a pinion gear. More concretely, as the pinion gear 45 which is connected to the shutter moving motor 300 is rotated, the pair of racks, which mesh with the pinion gears, move in the opposition direction from each other, causing thereby the shutters 44*a* and 44*b* structured to move with the corresponding racks, to move in the opposite direction from each other. The rear surface of each of the shutters 44*a* and 44*b* is coated with a small amount of grease, that is, lubricant for minimizing the friction between the shutters 44*a* and 44*b* and air ducts 42*a* and 42*b*, respectively.

These shutters 44*a* and 44*b* are slid by the control unit 200 by an amount which corresponds to the widthwise dimension of a sheet of the recording medium used for image formation (fixation; image heating process), in terms of the recording medium conveyance direction. Thus, the outlets 43*a* and 43*b* of the air ducts 42*a* and 42*b* are adjusted in width (in terms of direction X in FIG. 4, that is, the widthwise direction of the recording medium). Consequently, the cooling wind (air) generated by the cooling fans 41*a* and 41*b* is blown at the noncontact portions (portions which do not contact the recording medium), according to the widthwise dimension of the recording medium. Therefore, it is possible to cool only the noncontact portions of the fixation roller 5*a*, that is, the lengthwise end portions, in terms of the widthwise direction, without cooling the contact area of the fixation roller 5*a*.

The shutter moving motor 300 used in this embodiment is a stepping motor. It rotates for a length of time (proportional to the number of pulses) which is in accordance with the command it receives from the control unit 200. The shutter moving motor 300 can move the shutters 44*a* and 44*b* to their preventive position (first position) in which they prevent the noncontact portions of the fixation roller 5*a* from excessively increasing in temperature. Further, the cooling unit 500 is provided with a home position sensor 46, which functions as a shutter position detecting means which detects whether or not the shutters 44*a* and 44*b* are in their home position (second position), that is, the standby position, in which they keep the air outlets 43*a* and 43*b* completely closed (air ducts are completely blocked). That is, the shutters 44*a* and 44*b* are moved from the home position to one of the positions which are correspondent to the widthwise dimension of the recording medium.

The home position sensor 46 in this embodiment is a photo-interrupter. It detects the position of the shutter 44*a*, based on the position of the flag portion (integral part of shutter 44*a*) of the shutter 44*a* when the flag blocks the beam of light emitted by the photo-interrupter. That is, the image forming apparatus 100 is structured so that the control unit 200 can determine the position of the shutter 44*a* by monitoring the output of the photo-interrupter. By the way, even though the shutters 44*a* and 44*b* are opposite to each other in the direction of movement, they are moved together. Therefore, determining the position of the shutter 44*a* can determine the position of the shutter 44*b*. Thus, the image forming apparatus 100 in this embodiment is provided with only the means for detecting the position of the shutter 44*a*; it is not provided with the means for detecting the position of the shutter 44*b*. By the way, the image forming apparatus 100 may be provided with the means for detecting the position of the shutter 44*b* as well, in addition to the means for detecting the position of the shutter 44*a*.

The stopper 47 is positioned on the outward side of the home position sensor 46, in terms of the lengthwise direction of the fixation roller 5*a* (widthwise direction of the recording medium). This stopper 47 is for mechanically forcing the shutters 44*a* and 44*b* to stop, if the home position sensor 46 and/or control unit 200 happens to develop problems. That is, as the shutter 44*a* comes into contact with the stopper 47, it is prevented from moving further. In other words, the image forming apparatus 100 is structured so that the shutters 44*a* and 44*b* are enabled to move outward beyond their home position.

In terms of the lengthwise direction of the fixation roller 5*a* (widthwise direction of the recording medium), the stopper 48 is positioned on the inward side of the most outward position for the shutter 44*a* (position of the shutter 44*a* when the narrowest sheet $P_{min}$ of the recording medium usable by image forming apparatus is in use). This stopper 48 is a component with which the shutter 44*a* collides to be mechanically prevented from moving further, as the home position sensor 46 and/or control unit 200 happens to develop problems. More concretely, the image forming apparatus 100 is structured so that the shutters 44*a* and 44*b* are prevented from moving in their opening direction Z more than a present distance (18 mm in this embodiment). In other words, the image forming apparatus 100 is structured so that the shutters 44*a* and 44*b* are allowed to move inward of their most outward position in which they are normally allowed to be located.

As the control unit 200 receives an image formation command inputted by a user through the host computer, which is connected to the image forming apparatus 100, or the control panel 202 of the image forming apparatus 100, it makes the image forming apparatus 100 carry out the following sequence.

As the control unit 200 receives the image formation command, it drives the shutter moving motor 300 for such a length of time (proportional to the number of driving pulses) that corresponds to the recording medium size, that is, the information of the size of the sheet of the recording medium to be used for the image formation (sheet of the recording medium, which is narrower than the widest sheet of the recording medium usable with image forming apparatus). As a result, the outlets 43*a* and 43*b* are adjusted in width. In a case where the sheets P of the recording medium used for the image formation are of the largest in widthwise dimension (size A3), the control unit 200 checks whether or not the shutters 44*a* and 44*b* are in their home position. If it determines that the shutters 44*a* and 44*b* are in their home position, it ends the shutter moving control without activating the shutter moving motor 300.

Then, the control unit 200 starts the image forming operation (which hereafter may be referred to simply as job). Then, after the completion of the job, the control unit 200 carries out the operation for moving the shutters 44*a* and 44*b* back into their reference position.

By the way, the timing with which the shutters 44*a* and 44*b* are opened does not need to be as described above. For example, in the case of a job for continuously forming an image on multiple sheets P of the recording medium (continuously fixing multiple images), the shutters 44*a* and 44*b* may be controlled so that they are opened in response to the outputs of the sub-thermistors 32 and 33, which detect the temperature of the noncontact portions (portions which do not contact the recording medium) of the fixation roller 5*a*. That is, the control may be such that the shutters 44*a* and 44*b* are opened at a point in time at which the temperature of the fixation roller 5*a* detected by the sub-thermistors 32 and 33 reaches a preset level (240 degrees). It this case, it is desired that the cooling fans 41*a* and 41*b* are kept stationary until the shutters 44*a* and 44*b* are fully opened.

FIG. 5 shows the relationship between the recording medium size and the number of motor driving pulses given to the shutter moving motor 300 to move the shutters 44*a* and 44*b* from their reference position. In this embodiment, the shutters 44*a* and 44*b* are given six positions relative to the reference position in which the shutters 44*a* and 44*b* remain closed. With this positional arrangement, it is possible to blow air at the proper portions (noncontact portions: portions which do not contact the recording medium) of the fixation roller 5*a*.

(Initial Check Sequence)

Next, referring to FIGS. 6A and 6B, the initial check sequence (which hereafter may be referred to as initial check process), which is for checking out the position of the shutters 44*a* and 44*b*, is described. When the image forming apparatus 100 is turned on, the location of the shutters 44*a* and 44*b* it is not known. Thus, the control unit 200 makes the image forming apparatus 100 carry out the initialization sequence, which places the shutters 44*a* and 44*b* in their reference position.

FIGS. 6A and 6B are timing charts for the initialization sequence to be carried out when the fixing device 5 is normal in operation (mechanism for moving the shutters 44*a* and 44*b* in normal operation). This operation is carried out as the control unit 200 outputs commands for controlling the various devices in the image forming apparatus 100 (outputs commands (signals) to each of various devices).

As the image forming apparatus 100 is turned on (as the main switch is pressed), first, the control unit 200 confirms whether or not the home position sensor 46 is on (point (1) in FIGS. 6A and 6B). Here, "sensor 46 is on" means that the beam of light emitted by the photo-interrupter is being blocked by the flag portion of the shutter 44*a*, whereas "sensor 46 is off" means that the beam of light emitted by the photo-interrupter is not being blocked by the flag portion. The detected state of the home position sensor 46 affects how the operational sequences are carried out thereafter.

Referring to FIG. 6A, in a case where the home position sensor 46 is off, the shutters 44*a* and 44*b* are not in their home position. Thus, the control unit 200 causes the shutter moving motor 300 to run at a preset speed in the direction W', which corresponds to the direction indicated by an arrow mark W in FIG. 4, in order to cause the shutters 44*a* and 44*b* to move in the closing direction W. In this embodiment, the speed by which the shutter moving motor 300 is driven is set to 48 rpm. Then, if the home position sensor 46 is turned on within no less than a preset length of time (1.2 seconds in this embodiment) after the command to start rotating the shutter moving motor 300 was outputted (point (2) in FIGS. 6A and 6B), the control unit 200 stops the shutter moving motor 300, and ends the initial check process (point (3) in FIGS. 6A and 6B).

Next, referring to FIG. 6B, in a case where the home position sensor 46 is on when the image forming apparatus 100 was turned on, the initial check process (which will be described later) for finding whether or not the system for detecting the shutter position is normally functioning is carried out. That is, in this case, the shutter moving motor 300 is rotated at a preset speed (48 rpm in this embodiment) in the direction Z', which corresponds to the shutter opening directing indicated by an arrow mark Z in FIG. 4. Then, the control unit 200 checks whether or not the home position sensor 46 is turned off within a preset length (0.6 second) of time. If the home position sensor 46 is turned off within the preset length of time, the control unit 200 temporarily stops the shutter moving motor 300 (point (2) in FIG. 6B). Then, the control unit 200 waits for a preset length (0.1 second in this embodiment) of time, that is, until the vibrations caused by the motor disappear. Then, the control unit 200 rotates the shutter moving motor 300 in the direction W', which corresponds to the shutter closing direction W, causing thereby the home position sensor 46 to be turned on. As soon as the home position sensor 46 is turned on (point (3) in FIG. 6B), the control unit 200 ends the initial check process (point (4) in FIG. 6B).

In the normal operation (when shutter moving system is normal in operation), the above-described version of the initial check process is ended after being carried out following the abovementioned timing chart. However, if the shutter moving mechanism is abnormal in operation (in error condition), that is, the shutter moving mechanism is abnormally operating for some reason, the initial check process cannot be properly ended.

(Case where Shutter Moving Mechanism is Unlikely to be Quickly Restorable in Operation)

For example, it is a case where the friction between the air ducts 42*a* and 42*b* and the shutters 44*a* and 44*b*, respectively, became seriously large due to the repeated sliding of the shutters 44*a* and 44*b* relative to the air ducts 42*a* and 42*b*. More concretely, it is a case where the above-described grease ran out due to the repeated sliding of the shutters 44*a* and 44*b* against the air ducts 42*a* and 42*b*, which in turn prevents the shutters 44*a* and 44*b* from smoothly opening or closing. In this case, it cannot be expected that the shutter moving mechanism can be quickly restored in operation. In other words, the maintenance operation (re-application of grease or replacement of cooling unit) needs to be carried out by a service person. That is, the image forming apparatus 100 is prevented from performing an image forming operation (fixing operation which uses shutters 44*a* and 44*b*) until it is subjected to a maintenance operation.

However, the image forming apparatus 100 may be structured so that even in the above-described case, the apparatus 100 is allowed to form images as long as the shutters 44*a* and 44*b* are stuck in their home position, and the recording medium used for image formation is of the largest sheet $P_{max}$ in the widthwise dimension. In such a case, in order to prevent smaller sheets $P_{small}$ of the recording medium in terms of widthwise dimension from being used for image formation, the image forming apparatus 100 is desired to be structured so that a user cannot select smaller sheets $P_{small}$ of the recording medium through the monitor (liquid crystal display) of the control panel 202. For example, in order to prevent a user from selecting smaller sheets $P_{small}$ of the recording medium, the image forming apparatus 100 may be structured so that when the shutter moving mechanism is in the above-described abnormal condition, the key with which the monitor of the control panel 202 is provided to enable a user to select smaller sheets $P_{small}$ is grayed out (dimmed).

Further, the image forming apparatus 100 is desired to be structured so that in a case where the shutters 44*a* and 44*b* became stuck in their home position, that is, they cannot be moved out of the home position, the apparatus 100 can be operated in a special mode in which it can be operated at a low level of productivity. In other words, the apparatus 100 may be structured so that even when the shutters 44*a* and 44*b* are stuck in the home position (if apparatus 100 is in normal condition, shutters 44*a* and 44*b* are moved), an image forming operation which uses small sheets $P_{small}$, can be carried out by reducing the apparatus 100 in productivity. With the apparatus 100 reduced in productivity, it is possible to reduce the rate with which the noncontact portions of the fixation roller 5*a* increase in temperature. In this case, the control unit 200 controls (outputs commands to) each of the various devices to reduce the image formation speed of the apparatus 100.

Incidentally, the image forming apparatus 100 is desired to be structured so that in a case where the shutters 44*a* and 44*b* became stuck between the home position (closed position) and the control position (open position) (sensor 46 remains turned off), the apparatus 100 is prevented from forming an image regardless of the recording medium dimension in terms of the widthwise direction.

(Case in which Quick Recovery is Possible)

This is a case where foreign substances, such as dust, unexpectedly entered the rack-and-pinion mechanism, and/or areas of contact between the shutters 44*a* and 44*b* and air ducts 42*a* and 42*b*, respectively. In this case, it is possible that the cooling unit 500 will be quickly normalized.

Therefore, it is unwise to structure the image forming apparatus 100 so that in a case where the shutter moving mechanism became abnormal in operation, the apparatus 100 is prevented from forming images, even if it is possible for the shutter moving mechanism to be quickly normalized. Because such a structural arrangement unnecessarily reduces the usability of image forming apparatus 100, that is, it makes it impossible to use the image forming apparatus 100 (or apparatus 100 has to be used at a reduced image formation speed) until the apparatus 100 is repaired by a service person, the situation is extremely inconvenient for a user.

In this embodiment, therefore, in the case described above, a recovery sequence (recover process) for testing whether or not the mechanism for moving shutters 44*a* and 44*b* can be quickly normalized is carried out. More concretely, the control unit 200 can output a command for repeatedly and alternately moving the shutters 44*a* and 44*b* in the opening direction X and closing direction Z for several times, as will be described later. In this embodiment, the number of repetition is set to two. If the mechanism for moving the shutter 44*a* and 44*b* recovers through the above-described recovery sequence, the control unit 200 determines that the image forming apparatus 100 can restart the interrupted image forming operation. That is, in a case where the mechanism for moving the shutters 44*a* and 44*b* was normalized, it is possible to allow the image forming apparatus 100 to continue to form images. In other words, this structural arrangement makes it possible to provide an image forming apparatus that is highly satisfactory to a user in terms of usability.

Further, the image forming apparatus 100 is structured so that if the mechanism for moving the shutter 44*a* and 44*b* can not be restored in operation through the above-described recovery process, the control unit 200 determines that the mechanism for moving the shutter 44*a* and 44*b* cannot be quickly restored, and outputs an error message.

By the way, the following case can also be thought of as another case in which the mechanism for moving the shutter 44*a* and 44*b* can be quickly restored in operation. That is, it is a case where a part or parts of the area of contact between the shutters 44*a* and 44*b* and the air ducts 42*a* and 42*b* ran out of grease. In this case, the grease in the other parts of the interface can be spread by making the image forming apparatus 100 carry out the recovery sequence, in order to re-lubricate the part or parts of the area of contact between the shutters 44*a* and 44*b* and air ducts 42 and 42*b*, respectively, which ran out of the grease, to normalize (restore) the mechanism for moving the shutters 44*a* and 44*b* in operation.

(Recovery Sequence)

In this embodiment, therefore, the recovery sequence is carried out to enable the fixing device 5 to carry out the normal fixing operation, that is, the fixing operation in which the shutters 44*a* and 44*b* are used, to send cooling air, as much as possible, to the noncontact portions of the fixation roller 5*a* to cool the noncontact portions, even in a case where anomalies such as the above-described ones occur.

Figure 7A:
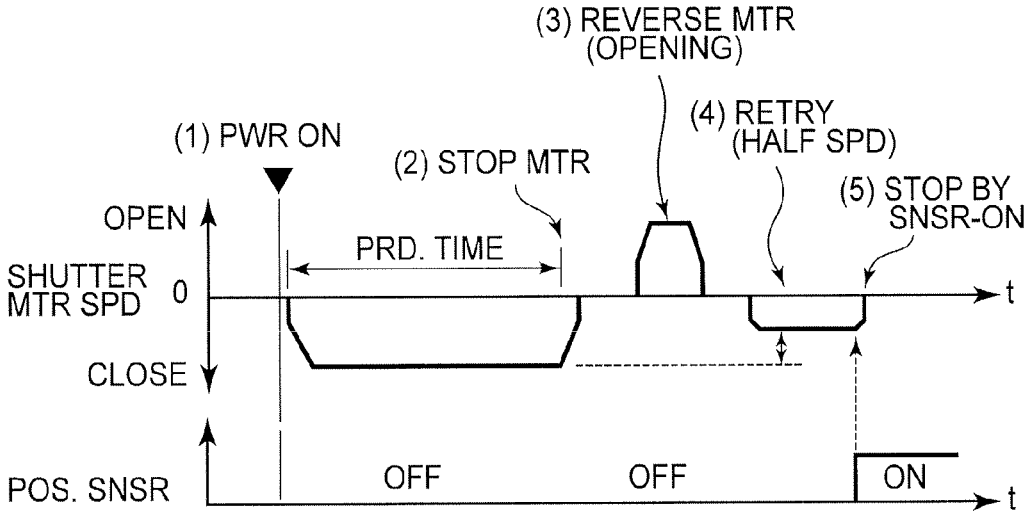
FIGS. 7A and 7B are timing charts of recovery sequence.
Figure 7B:
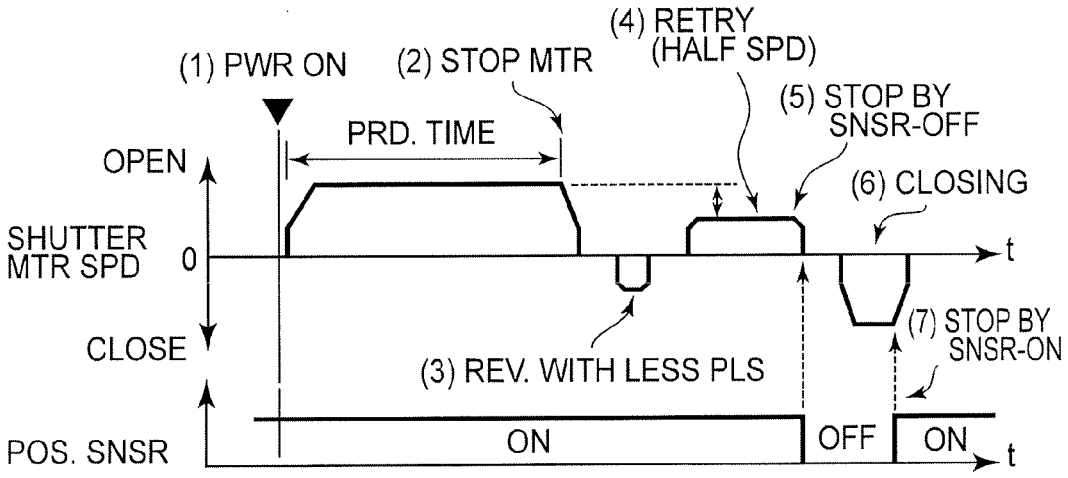

FIGS. 7A and 7B are timing charts of the recovery sequence which is to be carried out as an anomaly occurs to the mechanism for moving the shutters 44*a* and 44*b* (case in which shutters 44*a* and 44*b* stopped sliding). This recovery sequence also is carried out in response to the command (signal) outputted by the control unit 200 to each of various devices. Described next are two cases in which the recovery sequence is carried out.

(Case in which Shutters are not in Home Position)

FIG. 7A shows an operational sequence to be carried out in a case where the home position sensor 46 is off when the image forming apparatus 100 was turned on (shutters 44*a* and 44*b* are not in home position, being therefore open).

As the image forming apparatus 100 is turned on (electric power source ON), the control unit 200 checks the state of home position sensor 46 (point (1) in FIG. 7A). If the home position sensor 46 is off, the control unit 200 outputs such a command that makes the shutter moving motor 300 rotate at a preset speed (48 rpm in this embodiment) in the rotational direction W', which corresponds to the closing direction W of the shutters 44*a* and 44*b*.

Then, the control unit 200 begins to measure, with the use of a timer 201*d* (measuring portion, shown in FIG. 2) in the control unit 200, the length of time which has elapsed after the command for rotating the shutter moving motor 300 was outputted. If the home position sensor 46 does not turn on even after the length of time measured by the timer 20*d* reaches a value preset to be longer than the length of time it takes for the home position sensor 46 to turn on when the mechanism for moving the shutters 44*a* and 44*b* is normal, the control unit 200 stops the shutter moving motor 300. In this embodiment, this preset length of time is 1.2 second. That is, the control unit 200 outputs a command for stopping the rotation of the shutter moving motor 300 (point (2) in FIG. 7A).

Then, the control unit 200 keeps the shutter moving motor 300 stationary for a preset length of time (0.1 second in this embodiment). Then, it attempts to rotate the shutter moving motor 300 in the opposite direction, that is, the direction to move the shutters 44*a* and 44*b* in the opening direction Z. That is, the control unit 200 drives the shutter moving motor 300 so that the shutter moving motor 300 rotates in the rotational direction Z' (which corresponds to opening direction Z) for a preset length of time (0.4 second in this embodiment) (point (3) in FIG. 7A). That is, the control unit 200 outputs such a command that drives the shutter moving motor 300 for a preset length of time (0.4 second in this embodiment), that is, outputs driving pulses, the number of which corresponds to the preset length of time. In this embodiment, the speed at which the shutter moving motor 300 is rotationally driven in the direction Z' (which corresponds to opening direction Z) is the same as the shutter moving motor 300 is driven in the rotational direction W' (which corresponds to closing direction W). However, the former may be different from the latter.

It can be expected that as the shutter moving motor 300 is rotated in the rotational direction Z' (which corresponds to opening direction Z), the foreign substances having entered the area of contact between the shutters 44*a* and 44*b* and air ducts 42*a* and 42*b*, and/or the rack-and-pinion mechanism, will possibly be expelled. In other words, driving the shutter moving motor 300 as described above increases the possibility that the mechanism for moving the shutters 44*a* and 44*b* will be normalized in operation.

Then, the control unit 200 temporarily stops the shutter moving motor 300, and then, attempts to drive again the shutter moving motor 300 in the rotational direction W' (which corresponds to closing direction W), at a speed which is slower than the speed at which the shutter moving motor 300 was initially driven in the recovery sequence (speed at which shutter moving motor 300 was initially driven in rotational direction W') (point (4) in FIG. 7A).

Figure 8:
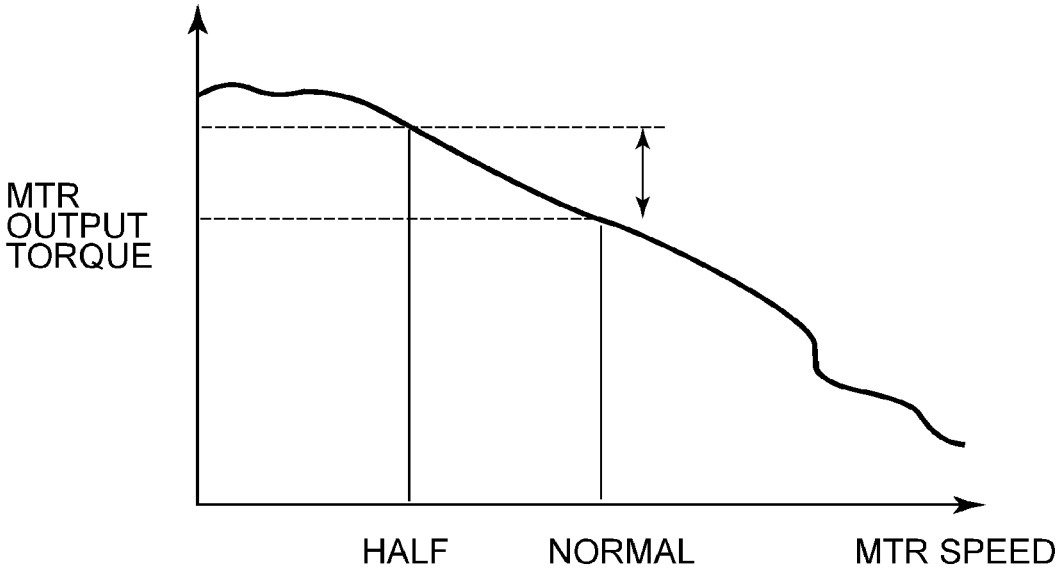
FIG. 8 is a drawing which shows the characteristics of the shutter moving motor in terms of output.

In this embodiment, this speed, at which the shutter moving motor 300 is driven in the rotational direction W' for the second time in the recovery sequence is half the normal speed (normal speed (48 rpm in this embodiment) in FIG. 8) at which the shutter moving motor 300 is initially driven in the rotational direction W' (which corresponds to closing direction W) in the recovery sequence. The reason for reducing the shutter moving motor 300 in speed is for increasing the shutter moving motor 300 in output torque, as will be understood from FIG. 8, which shows the relationship between the number of revolution of the shutter moving motor 300 and the output torque of the shutter moving motor 300. That is, reducing the speed, that is, the number of revolution, at which the shutter moving motor 300 is driven, increases the shutter moving motor 300 in its output torque. Thus, it increases the possibility that the mechanism for moving the shutters 44*a* and 44*b* will be normalized in operation.

Then, the control unit 200 outputs the command for rotating the shutter moving motor 300 in the rotational direction W' (which corresponds to closing direction W) for the second time. Then, it checks whether or not the home position sensor 46 turns on while the length of time which begins to be measured by the timer 201*d* after the outputting of the command reaches a preset value (2.3 seconds in this embodiment). If the home position sensor 43 turns on, the control unit 200 determines that the mechanism for moving the shutters 44*a* and 44*b* has been normalized in operation. That is, as the home position sensor 46 turns on, the control unit 200 outputs a command for stopping the shutter moving motor 300 (point (5) in FIG. 7A), and ends the recovery sequence. Since the mechanism for moving the shutters 44*a* and 44*b* has been normalized in operation, the image forming apparatus 100 is allowed to carry out normal image forming processes (fixing process).

Moreover, the control unit 200 checks whether or not the home position sensor 46 remains turned off while the length of time which begins to be measured by the timer 201*d* immediately after the command for rotating the shutter moving motor 300 in the rotational direction W' (corresponds to closing direction W) was outputted for the second time reaches the preset value (2.3 seconds in this embodiment). If the home position sensor 46 remains turned off, the control unit 200 determines that the cooling unit 500 cannot be quickly restored in operation. That is, as the length of time which begins to be measured by the timer 201*d* immediately after the command for rotating the shutter moving motor 300 in the rotational direction W' was outputted for the second time reaches a preset value (2.3 seconds), the control unit 200 outputs the command for stopping the shutter moving motor 300, and ends the recovery sequence. In this case, the control unit 200 outputs such an error message as "Please call service person", on the monitor of the control panel 202. By the way, this error message does not need to be such as the one presented above, as long as it can inform a user of the anomaly.

By the way, in this embodiment, in a case where the shutters 44*a* and 44*b* are not in their home position as shown in FIG. 7A, the direction in which the shutter moving motor 300 is initially rotated is the rotational direction W' (which corresponds to closing direction W). However, the direction in which the shutter moving motor 300 is initially rotated in the recovery sequence may be opposite from the direction in this embodiment. That is, the initial direction in which the shutter moving motor 300 is to be rotated in the recovery sequence may be the rotational direction Z' (which corresponds to opening direction Z), and then, rotational direction W' (which corresponds to closing direction W), and then, rotational direction Z' (which corresponds to opening direction Z), and so on. In this case, the length of time the shutter moving motor 300 is to be driven in the rotational direction Z' is desired to set to a value (pulse count) which is less than the value of the length of time required for the shutter 44*a* to move from the outermost position to the stopper 47 when the mechanism for moving the shutters 44*a* and 44*b* is normal in operation.

(Case in which Shutters are in Home Position)

FIG. 7B is a timing chart for the recovery sequence to be carried out when the home position sensor 46 is on (shutters 44*a* and 44*b* are in home position, and therefore, keeping air ducts 42*a* and 42*b* closed) when the image forming apparatus 100 was turned on.

As the image forming apparatus is turned on, the control unit 200 checks the state of home position sensor 46 (point (1) in FIG. 7B). If the home position sensor 46 is on, the control unit 200 attempts, for a preset length of time (0.6 second in this embodiment), to rotate the shutter moving motor 300 in the rotational direction Z' in order to cause the shutters 44*a* and 44*b* to move in the opening direction Z.

If the home position sensor 46 does not turn off even after the length of time which begins to be measured by the timer 201*d* as soon as the image forming apparatus was turned on, reaches a preset length of time (0.6 second), which was set to be longer than the length of time for the home position sensor 46 to turn off when the mechanism for moving the shutter 44*a* and 44*b* is in the normal condition, the control unit 200 carries out the following process. That is, the control unit 200 outputs a command for stopping the rotation of the shutter moving motor 300 at this point in time (point (2) in FIG. 7B).

Then, the control unit 200 keeps the shutter moving motor 300 stationary for a preset length of time (0.1 second). Then, it drives the shutter moving motor 300 for a preset length of time in the rotational direction W' (which corresponds to closing direction W), which is opposite from the direction in which the shutter moving motor 300 was driven up to this point in time (outputs preset number of driving pulses) (point (3) in FIG. 7B). In this case, the number of pulses is set to be smaller than the number of pulses necessary to move the shutters 44*a* and 44*b* from their home position to the stopper 47 when the mechanism for moving the shutter 44*a* and 44*b* is in the normal condition. In this embodiment, the speed at which the shutter moving motor 300 is rotationally driven in the direction W' (which corresponds to closing direction W) is the same as the speed at which the shutter moving motor 300 is driven in the rotational direction Z' (which corresponds to opening direction Z). However, the former may be made to be different from the latter.

Until the length of time which begins to be measured by the timer 201*d* upon the outputting of the command for rotating the shutter moving motor 300 in the rotational direction W' (which corresponds to closing direction W) by the control unit 200 reaches a preset value (0.6 second in this embodiment), the control unit 200 checks whether or not the home position sensor 46 turns on. If the home position sensor 46 does not turn on, the control unit 200 stops driving the shutter moving motor 300 upon the elapsing of the preset length of time (0.6 second in this embodiment).

Then, the control unit 200 keeps the shutter moving motor 300 stationary for a preset length of time (0.1 second in this embodiment). Then, it outputs, for the second time, the command for driving the shutter moving motor 300 in the rotational direction Z' (which corresponds to opening direction Z) for a preset length of time (1.1 second in this embodiment), at a speed which is slower than the speed at which the shutter moving motor 300 was initially driven in the recovery sequence (in rotational direction Z') (period (4) in FIG. 7B). In this embodiment, the speed is reduced to half the normal speed (48 rpm in FIG. 8) at which the shutter moving motor 300 was initially driven (in rotational direction Z') in the recovery sequence. The reason for reducing the shutter moving motor 300 in speed is for increasing the shutter moving motor 300 in output torque, as will be understood from FIG. 8, which shows the relationship between the number of revolution of the shutter moving motor 300 and the output torque of the shutter moving motor 300. That is, reducing the speed, that is, the number of revolution, at which the shutter moving motor 300 is driven, increases the shutter moving motor 300 in its output torque. Thus, it increases the possibility that the mechanism for moving the shutters 44*a* and 44*b* will be normalized in operation.

Then, the control unit 200 outputs, for the second time, the command for rotating the shutter moving motor 300 in the rotational direction Z' (which corresponds to opening direction Z). Then, it checks whether or not the home position sensor 46 turns off while the length of time which began to be measured by the timer 201*d* upon outputting of the command reaches a preset value (1.1 second in this embodiment). If the home position sensor 43 turns off, the control unit 200 stops driving the shutter moving motor 300 after the elapse of the preset length of time (1.1 second) (point (5) in FIG. 7B).

Then, the control unit 200 keeps the shutter moving motor 300 stationary for a preset length of time. Then, it outputs, for the second time, the command for rotating the shutter moving motor 300 in the rotational direction W' (which corresponds to closing direction W) (point (6) in FIG. 7B). Then, it checks whether or not the home position sensor 46 turns on while the length of time which began to be measured by the timer 201*d* upon the second outputting of the command for rotating the shutter moving motor 300 in the rotational direction W' (which corresponds to closing direction W) reaches a preset value (0.6 second). If the home position sensor 43 turns on, the control unit 200 stops driving the shutter moving motor 300 (point (7) in FIG. 7B), and ends the recovery sequence. Since the mechanism for moving the shutters 44*a* and 44*b* has been normalized in operation, the image forming apparatus 100 is allowed to carry out normal image forming processes (fixing process).

Further, the control unit 200 checks whether or not the home position sensor 46 remains turned on while the length of time which began to be measured by the timer 201*d* upon the second outputting of the command for rotating the shutter moving motor 300 in the rotational direction Z' (corresponds to opening direction Z) reaches the preset value (0.6 second). If the home position sensor 46 remains turned on, the control unit 200 determines that the cooling unit 500 cannot be quickly restored in operation. That is, as the length of time which begins to be measured by the timer 201*d* upon the second outputting of the command for rotating the shutter moving motor 300 in the rotational direction Z' (which corresponds to opening direction Z) reaches a preset value (0.6 second), the control unit 200 outputs the command for stopping the shutter moving motor 300, and ends the recovery sequence. In this case, the mechanism for moving the shutters 44*a* and 44*b* failed to be normalized in operation. Therefore, the image forming apparatus is prevented from carrying out the normal image formation process (fixation process) (or allowed to carry out image formation process at a slower speed, that is, at lower level of productivity).

Further, in this case, the control unit 200 outputs to the control panel 202, a command for informing a user of the occurrence of anomaly to the image forming apparatus. Upon reception of this command, the control panel 202 outputs such an error message as "Please call service person", on its monitor. By the way, this error message does not need to be such as the one suggested above, as long as it can inform a user of the anomaly.

By the way, in this embodiment, in a case where the shutters 44*a* and 44*b* are in their home position as shown in FIG. 7B, the direction in which the shutter moving motor 300 is initially rotated is the rotational direction Z' (which corresponds to opening direction Z). However, the direction in which the shutter moving motor 300 is initially rotated in the recovery sequence may be opposite from the direction in this embodiment. That is, the initial direction in which the shutter moving motor 300 is to be rotated in the recovery sequence may be the rotational direction W' (which corresponds to opening direction W), and then, rotational direction Z' (which corresponds to closing direction Z), and then, rotational direction W' (which corresponds to opening direction W), and so on. In this case, the length of time the shutter moving motor 300 is to be driven in the rotational direction W' is desired to set to a value (pulse count) which is less than the value of the length of time (pulse count, which is 8 in this embodiment) required for the shutter 44*a* to move from the home position to the stopper 48 when the mechanism for moving the shutters 44*a* and 44*b* is the normal condition.

(Operational Flow of Initial Check Sequence and Operational Flow of Recovery Sequence)

Figure 9:
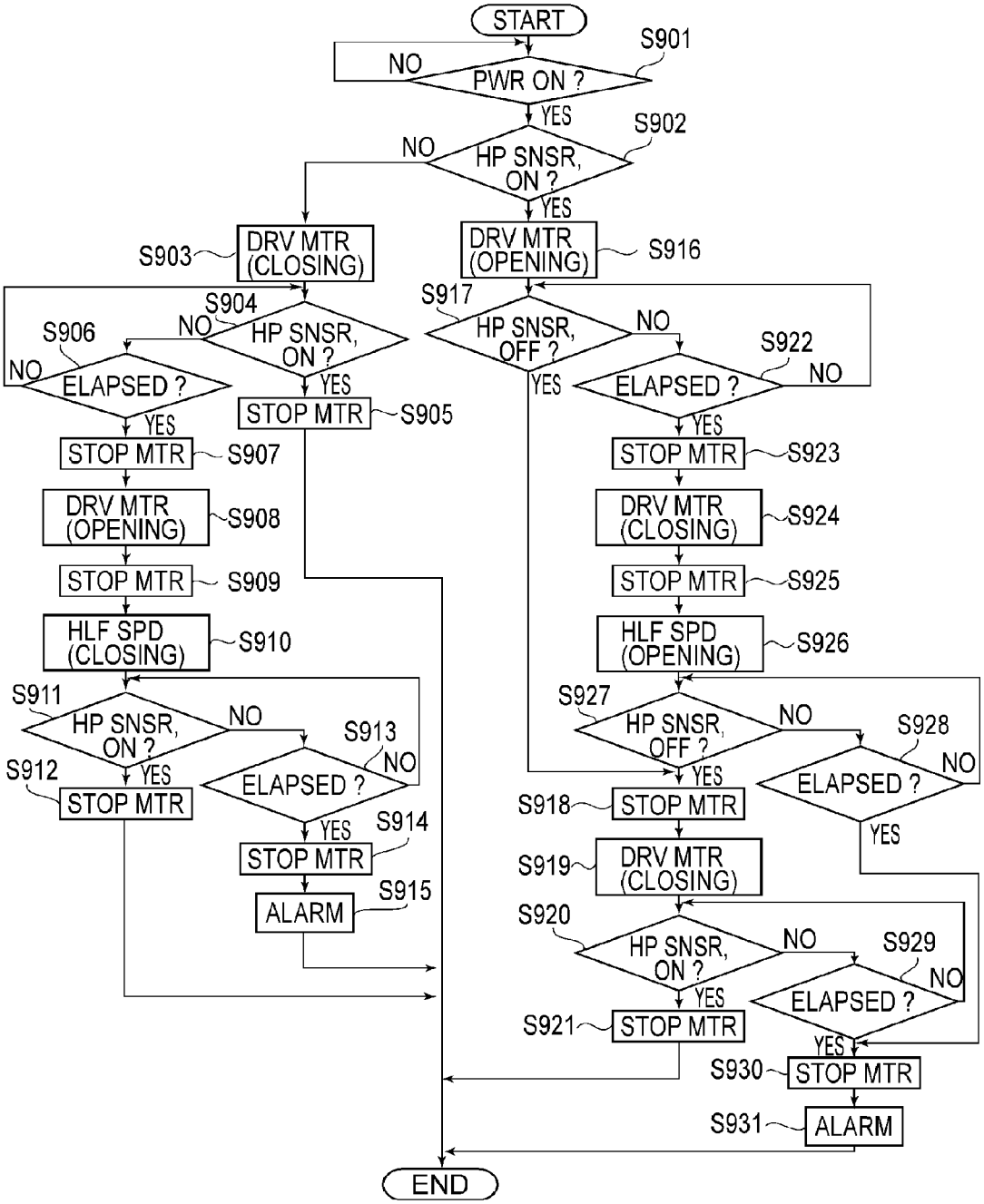
FIG. 9 is a flowchart of the recovery sequence.

Next, referring to FIG. 9, the operational flow of the initial check sequence and the operational sequence of the recovery sequence are described. FIG. 9 is a flowchart of a combination of the initial check sequence and recovery sequence, which the control unit 200 carries out by controlling (by outputting commands) the operation of various devices. Here, by the way, the home position sensor 46 and shutter moving motor 300 are referred to simply as HP sensor and motor, respectively.

As the electric power source of the image forming apparatus is turned on (main switch is pressed) (S901), the control unit 200 checks the state of the HP sensor 46 (S902). Hereafter, each of two cases which are different in the state of the HP sensor 46 will be described.

(Case where HP Sensor is on)

If the HP sensor 46 is off in S902, the control unit 200 determines that the shutters 44*a* and 44*b* are not in their home position (reference position). Then, it drives the motor 300 in the rotational direction W' to move the shutters 44*a* and 44*b* in the closing direction W (S903). Then, it checks the state of the HP sensor 46 (S904). If it detects that the HP sensor 46 has turned on, it stops the motor 300 (S905), and ends the initial check sequence.

On the other hand, if the HP sensor 46 does not turn on for a preset length of time (1.2 second in this embodiment) (S906), the control unit 200 stops the motor 300 (S907). Then, it keeps the motor 300 stationary for a preset length of time (0.1 second in this embodiment). Then, it drives the motor 300 in the rotational direction Z' (which corresponds to opening direction Z) for a preset length of time (0.4 second) (outputs preset number of motor driving pulse)(S908). Then, it keeps the motor 300 stationary for a preset length of time (S909), and drives the motor 300 again in the rotational direction W' (which corresponds to closing direction W), at half (24 rpm) the speed (48 rpm) at which the motor 300 was initially driven (S910). Then, if it detects that the home position sensor 46 has turned on (S911), it stops the motor 300 (S912), and ends the recovery sequence.

On the other hand, if the home position sensor 46 does not turn on for a preset length of time in S911 (S913), the control unit 200 determines that an anomaly which cannot be quickly remedied occurred to the mechanism for moving the shutter 44*a* and 44*b*, and it stops the motor 300 (S914). Then, the control unit 200 displays an error message or an alarm on the control panel 202, and places the image forming apparatus in the state in which the image forming apparatus cannot be operated, or the state in which the apparatus is allowed to operate in a limited capacity (S915).

(Case where HP Sensor is on)

If the control unit 200 detects that the home position sensor 46 is on in S902, it cannot determine whether the shutters 44*a* and 44*b* are in their home position or have moved in the closing direction. Thus, the control unit 200 drives the motor 300 in the rotational direction Z' (which corresponds to opening direction Z) (S916). Then, as it detects that the home position sensor 46 has turned off, it stops the motor 300 (S918). Then, it keeps the motor 300 stationary for a preset length of time (0.1 second in this embodiment). Then, it drives the motor 300 in the rotational direction W' to move the shutters 44*a* and 44*b* in the closing direction W (S919). Then, as it detects that the home position sensor 46 has turned on (S920), it stops the rotation of the motor 300 (S921), and ends the initial check sequence.

On the other hand, if the home position sensor 46 does not turn off for a preset length of time (0.6 second in this embodiment) in S917 (S922), the control unit 200 stops the motor 300 (S923). Then, it drives the motor 300 in the rotational direction W' (which corresponds to closing direction W) (S924). Then, it drives the motor 300 for a preset length of time (which corresponds to preset number (8) of pulses, and stops the motor 300 (S925).

Then, the control unit 200 drives the motor 300 again in the rotational direction Z' (which corresponds to opening direction Z), at half (24 rpm) the speed (48 rpm) at which the motor 300 was initially driven (S926). Then, if the control unit 200 detects that the home position sensor 46 has turned off before the elapse of a preset length of time (1.1 second in this embodiment) after the outputting of the command for driving the motor 300 in the rotational direction Z' (S927), it temporarily stops the motor 300 (S918). Then, it drives again the motor 300 in the rotational direction W' to move the shutters 44*a* and 44*b* in the closing direction W (S919). During this driving of the motor 300, if the control unit 200 detects that the home position sensor 46 turns on before the elapse of a preset length of time (0.6 second in this embodiment) after the re-outputting of the command for driving the motor 300 in the rotational direction W' (S920), the control unit 200 stops the motor 300 (S921), and ends the recovery sequence.

On the other hand, if the home position sensor 46 does not turn off for a preset length of time (1.1 second in this embodiment) (S928), the control unit 200 determines that an anomaly which cannot be quickly remedied has occurred, and then, it stops the motor 300 (S930). Then, it causes the control panel 202 to displays an error message, or an alarm, and places the image forming apparatus in the state in which the image forming apparatus is prevented from operating (or can operate only in limited capacity) (S931).

Similarly, if the home position sensor 46 fails to turn on for a preset length of time (0.6 second in this embodiment) (S929), the control unit 200 determines that an anomaly which cannot be quickly remedied has occurred. Then, it stops the motor 300 (S930). Then, it causes the control panel to display an error message or an alarm, and places the image forming apparatus in the state in which the image forming apparatus is prevented from operating (is limited in capacity) (S931).

If an image forming apparatus is provided with the above-described structural arrangement, even if an anomaly occurs to its mechanism for moving the shutters 44*a* and 44*b*, it attempts to restore the mechanism for moving the shutter 44*a* and 44*b*. That is, even if the mechanism for moving the shutter 44*a* and 44*b* malfunctions, it does not occur that the image forming apparatus is simply prevented from operating (or allowed to operate in limited capacity). Instead, the apparatus attempts to recover from the malfunction to continue to operate. Thus, providing an image forming apparatus with the above-described structural arrangement can improve an image forming apparatus in the level of user satisfaction.

Embodiment 2

Figure 10A:
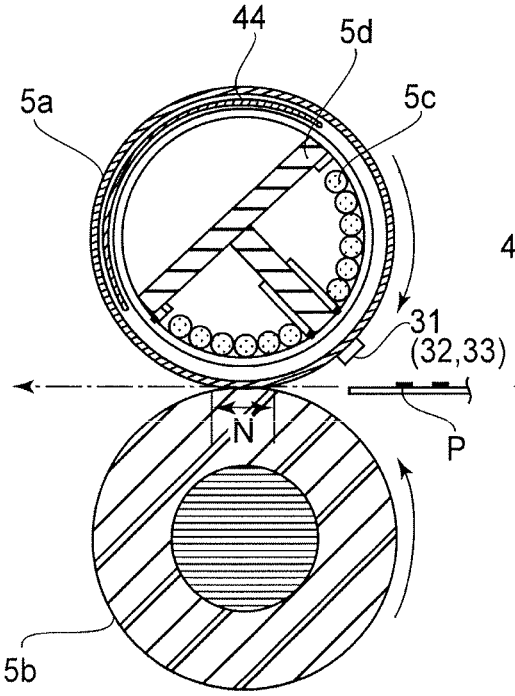
FIGS. 10A, 10B, and 10C are schematic sectional views of the fixing device which employs a heating system based on electromagnetic induction, and show the general structure of the device. Also.
Figure 10B:
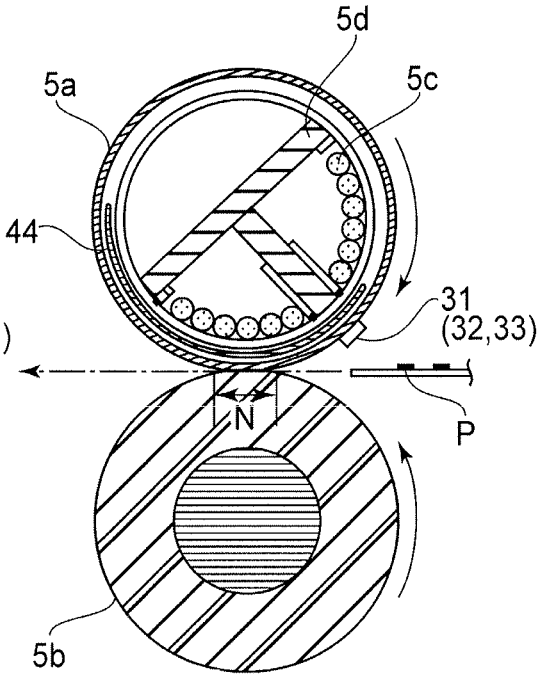
Figure 10C:
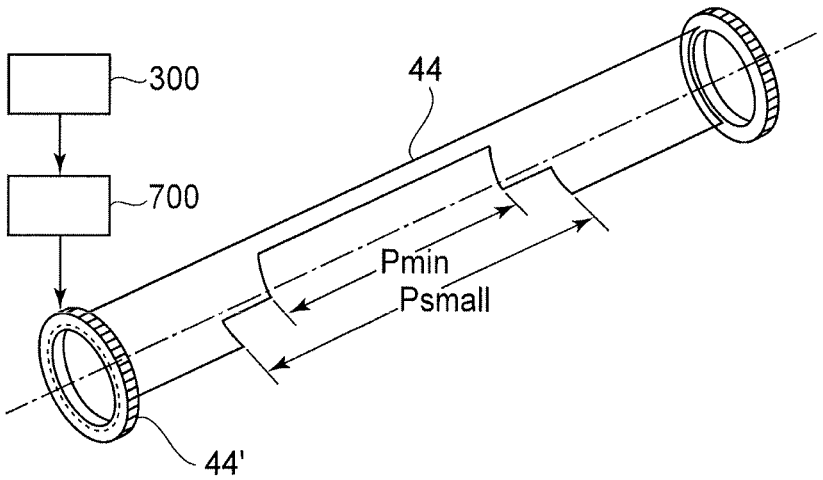

Next, referring to FIGS. 10A, 10B, and 10C, the second embodiment of the present invention is described. FIG. 10A is a schematic sectional view of the fixing apparatus in this embodiment when the shutter 44 is in its home position. FIG. 10B is a schematic sectional view of the fixing device when the shutter 44 is in its retreat position. FIG. 10C is a schematic sectional view of the shutter 44.

This embodiment is substantially different from the first embodiment only in the heating system for heating the fixation roller 5*a*, and the mechanism for preventing the noncontact portions of the fixation roller 5*a* from excessively increasing in temperature. That is, other portions of the image forming apparatus in this embodiment are similar in structure to the counterparts in the first embodiment. Therefore, they are not described in detail.

Referring to FIGS. 10A and 10B, in this embodiment, a heating system employs a heating method which is based on electromagnetic induction. More concretely, there are disposed an excitation coil 5*c* and a magnetic core 5*d* in the hollow of the fixation roller 5*a*. That is, as high frequency current flows through the excitation coil 5*c*, a magnetic flux is generated by the excitation coil 5*c*. This magnetic flux induces electric current in the electrically conductive layer of the fixation roller 5*a*. Thus, heat is generated in the electrically conductive layer by the induced current. The magnetic core 5*d* bears the function of guiding the magnetic flux generated by the excitation coil 5*c* toward the heating portion (upstream adjacencies of nip N) of the fixation roller 5*a*.

There are also disposed thermistors 31, 32 and 33, which are temperature sensors, in the immediate adjacencies of the peripheral surface of the fixation roller 5*a*, being aligned in the widthwise direction, and different in position. More concretely, in terms of the widthwise direction, the thermistor 31 is positioned at roughly center of the fixation roller 5*a*, and the thermistors 32 and 33 are positioned near the widthwise ends of the fixation roller 5*a*, one for one. Thus, the control unit 200 controls the temperature of the fixation roller 5*a*, by controlling the high frequency current to be supplied to the excitation coil 5*c* based on the output of the thermistor 31. Like in the first embodiment, the thermistors 32 and 33 are used to check the temperature increase which occurs to the noncontact portions of the fixation roller 5*a* when small sheets $P_{small}$ or smallest sheets $P_{min}$ are used for image formation (when the image on sheet $P_{small}$ or sheet $P_{min}$ is fixed).

Referring to FIGS. 10A and 10B, in this embodiment, a shutter 44 which is made of copper plate is used as a magnetic flux blocking member for preventing the noncontact portions of the fixation roller 5*a* from excessively increasing in temperature. The shutter 44 is arc-shaped in cross-section. More concretely, the shutter 44 is shaped so that its portion corresponding to the path of a smaller sheet $P_{small}$ of the recording medium usable with the fixing device 5, and its portion corresponding to the smallest sheet $P_{min}$ of the recording medium usable with the fixing device 5, are absent. It is rotatable by the driving force inputted to a gear 44' fixed to one of the widthwise ends of the shutter 44 from the shutter moving motor 300 through a gear train 700. That is, the fixing device 5 is structured so that the shutter 44 can be changed in position in terms of the circumferential direction of the fixation roller 5*a*.

By the way, the gear 44" fixed to the other widthwise end of the shutter 44 is for transmitting the driving force inputted into the opposite widthwise end of the shutter 44. More concretely, the fixing device 5 is provided with a rotational shaft (unshown), the lengthwise ends of which are provided with a pair of gears, one for one. This rotational shaft is positioned above the shutter 44, in such a manner that the pair of gears mesh with the gears 44' and 44", one for one. Therefore, as the driving force is inputted into the gear 44', it is transmitted to the gear 44" through the rotational shaft. Thus, the shutter 44 is prevented from becoming twisted.

FIG. 10A shows the state of the fixing device 5, in which the shutter 44 is in the retreat position, into which the shutter 44 has retreated from the area in which the fixation roller 5*a* is heated. That is, it shows the shutter 44 when the shutter 44 is in the position in which it is when the largest sheets $P_{max}$ is used for image formation. When the shutter 44 is in the position shown in FIG. 10A, it does not prevent the contact portion of the fixation roller 5*a* from being heated by electromagnetic induction.

In comparison, FIG. 10B shows the state of the fixing device 5, in which the shutter 44 is in the area in which the fixation roller 5*a* is heated by electromagnetic induction, and into which it has been moved by being counterclockwise rotated from the retreat position. That is, it shows the state of the fixing device 5, in which the fixing device 5 is when smaller sheets $P_{small}$ of the recording medium are used for image formation. When the fixing device 5 is in the state shown in FIG. 10B, the shutter 44 prevents noncontact portions of the fixation roller 5*a* from being heated by electromagnetic induction. By the way, the position in which the shutter 44 is placed when the smallest sheets $P_{min}$ are used for image formation, is farther downstream in terms of the counterclockwise direction than the position shown in FIG. 10B. Further, when the image forming apparatus is switched in the recording medium from a smaller sheet $P_{small}$ to the largest sheet $P_{max}$, the shutter 44 is rotated clockwise to be retracted into the position shown in FIG. 10A.

As described above, the control unit 200 changes the shutter 44 in position in response to the widthwise dimension of the recording medium P, by controlling the movement of the shutter moving motor 300.

Like the fixing device 5 in the first embodiment, the fixing device in this embodiment, which employs the shutter 44, is also made to carry out the recovery sequence as its mechanism (made up of gear 44', gear train 700) suddenly becomes abnormal in operation due to the intrusion of foreign substances into the mechanism, in order to make the mechanism recover from the anomaly. That is, the initial check sequence and recovery sequence in this embodiment are practically the same as those in the first embodiment, except that in this embodiment, the shutters 44*a* and 44*b* in the first embodiment, are substituted by the shutter 44. Thus, the initial check sequence and recovery sequence in this embodiment are not described in detail.

Thus, this embodiment also can improve the user satisfaction of an image forming apparatus (fixing device).

In the foregoing, the first and second embodiments of the present invention were described in detail. However, these embodiments are not intended to limit the present invention in scope. That is, the present invention is also applicable to various image forming apparatuses (fixing devices: image heating devices) which are different in structure from those in the first and second embodiments, within the scope of the present invention.

For example, in the above-described embodiments, the heating member (rotational heating member) was a fixation roller. However, the present invention is also applicable to a fixing device which employs a fixation belt. Further, in the above-described embodiments, the object (heating member) to be cooled by the air sent by the cooling device was the fixation roller 5*a*, which is positioned so that it contacts the unfixed toner image on the recording medium. However, the present invention is also applicable a fixing device structured so that the pressure roller 5*b* is cooled. Also, in this case, the pressure applying member may be in the form of a belt (pressure belt) instead of a roller.

Further, in the preceding embodiments, the image heating device was a fixing device. However, the present invention is also applicable to a glossing device which reheats a fixed toner image on a sheet of the recording medium to improving the image in gloss.

Moreover, in the above-described embodiments, the fixing device was structured so that the home position sensor 46 (as detecting portion) checks whether or not the shutters 44*a* and 44*b* are in the home position (retreat position). However, these embodiments are not intended to limit the present invention in scope.

For example, the present invention is also applicable to a fixing device structured so that the home position sensor 46 detects that the shutters 44*a* and 44*b* are in the position in which they prevent the noncontact portions of the fixation roller 5*a* from excessively increasing in temperature. In this case, the description of the fixing device is the same as that of the fixing device in the preceding embodiments, except for the shutter position to be detected by the home position sensor 46. Therefore, the device is not described in detail.

For example, when the shutter in the preventive position, the shutter moving motor 300 has only to be driven so that the shutter is to be initially moved in the closing direction, and then, in the opening direction (this sequence is to be repeated as necessary). Similarly, when the shutter is not in the preventive position, the shutter moving motor 300 has only to be controlled so that the shutter is initially moved in the opening direction, and then, in the closing direction (this sequence is to be repeated as necessary).

Further, in the preceding embodiments, the control unit 200, which functions as a controller, is an internal component of the image forming apparatus 100. However, the present invention is also applicable to a case in which a controlling device is an external device which is connected to an image forming apparatus through a communication line.

Further, in the preceding embodiments, the information regarding the state of the image forming apparatus (fixing device) was given to a user through the monitor of the control panel. However, these embodiments are not intended to limit the present invention in scope. That is, the present invention is also applicable to a combination of an image forming apparatus, and a controlling section (controller) which is connected to the image forming apparatus through a network cable, and outputs commands (signals) to the image forming apparatus through the network cable. In such a case, an error message or the like is displayed (disseminated) on the monitor that is connected to the host computer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 033342/2014 filed Feb. 24, 2014, which is hereby incorporated by reference.

What is claimed is:

1. An image heating apparatus comprising:

a heating member configured to heat a toner image on a recording material;

a fan;

a duct provided with an opening configured to discharge air supplied by said fan, toward said heating member;

a shutter configured to open and close said opening;

a motor configured to move said shutter;

a detector configured to detect that said shutter is in a predetermined position; and a controller configured to control an operation of said motor, wherein when said detector does not detect said shutter after a predetermined time elapses from production of a first instruction for moving said shutter toward the predetermined position, said controller produces a second instruction for moving said shutter in a direction away from the predetermined position.

2. An apparatus according to claim 1, wherein when said detector does not detect said shutter after a predetermined time elapses from production of the second instruction, said controller produces a third instruction for moving said shutter toward the predetermined position.

3. An apparatus according to claim 2, wherein said controller is configured to alternately produce the second instruction and the third instruction a predetermined number of times, and produces an instruction for notification of an anomaly of said motor if said detector does not detect said shutter despite the predetermined number of repetitions of productions of the second and third instructions.

4. An apparatus according to claim 3, further comprising a notifying portion configured to perform notification of an anomaly of said motor in response to the instruction for the notification from said controller.

5. An apparatus according to claim 1, wherein when said detector detects said shutter before the predetermined time elapses from the production of the second instruction, said controller permits an image heating process operation.

6. An apparatus according to claim 1, wherein said controller produces the second instruction with an output torque of said motor which is larger than an output torque of said motor produced with the first instruction.

7. An apparatus according to claim 1, wherein said controller controls an operation of said motor in accordance with the width of the recording material.

8. An apparatus according to claim 7, wherein said controller controls said motor to open said shutter when an image heating process is executed for a predetermined recording material having a width which is smaller than a maximum width of a recording material which is capable of being processed by said apparatus, and controls said motor to close said shutter when the image heating process is executed for the recording material having the maximum width which is capable of being processed by said apparatus.

9. An apparatus according to claim 8, wherein the predetermined position is a position in which said shutter is closed.

10. An image heating apparatus comprising:

a heating member configured to heat a toner image on a recording material;

a fan;

a duct provided with an opening configured to discharge air supplied by said fan, toward said heating member;

a shutter configured to open and close said opening;

a motor configured to move said shutter;

a detector configured to detect that said shutter is in a predetermined position; and a controller configured to control an operation of said motor, wherein when said detector does not detect said shutter after a predetermined time elapses from production of a first instruction for moving said shutter in a first direction, said controller produces a second instruction for moving said shutter in a second direction opposite the first direction.

11. An apparatus according to claim 10, wherein when said detector detects said shutter after a predetermined time elapses from production of the second instruction, said controller produces a third instruction for moving said shutter in the first direction.

12. An apparatus according to claim 11, wherein said controller is configured to alternately produce the second instruction and the third instruction a predetermined number of times, and produces an instruction for notification of an anomaly of said motor if said detector detects said shutter despite the predetermined number of repetitions of productions of the second and third instructions.

13. An apparatus according to claim 12, further comprising a notifying portion configured to perform notification of an anomaly of said motor in response to the instruction for the notification from said controller.

14. An apparatus according to claim 10, wherein when said detector comes not to detect said shutter before the predetermined time elapses from the production of the second instruction, said controller permits an image heating process operation.

15. An apparatus according to claim 10, wherein said controller produces the second instruction with an output torque of said motor which is larger than an output torque of said motor produced with the first instruction.

16. An apparatus according to claim 10, wherein said controller controls an operation of said motor in accordance with the width of the recording material.

17. An apparatus according to claim 16, wherein said controller controls said motor to open said shutter when an image heating process is executed for a predetermined recording material having a width which is smaller than a maximum width of a recording material which is capable of being processed by said apparatus, and control said motor to close said shutter when the image heating process is executed for the recording material having the maximum width which is capable of being processed by said apparatus.

18. An apparatus according to claim 17, wherein the predetermined position is a position in which said shutter is closed.

19. An image heating apparatus comprising:

a heating member configured to heat a toner image on a recording material;

an excitation coil configured to generate a magnetic flux for electromagnetic induction heating of said heating member;

a magnetic flux confining member configured to suppress the magnetic flux actable on said heating member from said excitation coil;

a motor configured to move said magnetic flux confining member;

a detector configured to detect that said magnetic flux confining member is in a predetermined position; and a controller configured to control an operation of said motor, wherein when said detector does not detect said magnetic flux confining member after a predetermined time elapses from production of a first instruction for moving said magnetic flux confining member toward the predetermined position, said controller produces a second instruction for moving said magnetic flux confining member in a direction away from the predetermined position.

20. An apparatus according to claim 19, wherein when said detector does not detect said magnetic flux confining member after a predetermined time elapses from production of the second instruction, said controller produces a third instruction for moving said magnetic flux confining member toward the predetermined position.

21. An apparatus according to claim 20, wherein said controller is configured to alternately produce the second instruction and the third instruction a predetermined number of times, and produces an instruction for notification of an anomaly of said motor if said detector does not detect said magnetic flux confining member despite the predetermined number of repetitions of productions of the second and third instructions.

22. An apparatus according to claim 21, further comprising a notifying portion for performing a notification of an anomaly of said motor in response to the instruction for the notification from said controller.

23. An apparatus according to claim 19, wherein when said detector detects said shutter before the predetermined time elapses from the production of the second instruction, said controller permits an image heating process operation.

24. An apparatus according to claim 19, wherein said controller produces the second instruction with an output torque of said motor which is larger than an output torque of said motor produced with the first instruction.

25. An apparatus according to claim 19, wherein said controller controls an operation of said motor in accordance with the width of the recording material.

26. An apparatus according to claim 25, wherein when an image heating process is executed for a predetermined recording material having a width which is smaller than a maximum width of a recording material which is capable of being processed by said apparatus, said controller controls said motor so that the magnetic flux actable on a region of said heating member not contacting the predetermined recording material is confined by said magnetic flux confining member, and when the image heating process is executed for the recording material having the maximum width which is capable of being processed by said apparatus, said controller controls said motor so that the magnetic flux actable on a region of said heating member contacting the maximum width recording material is not confined by said magnetic flux confining member.

27. An apparatus according to claim 26, wherein the predetermined position is a position in which the magnetic flux actable on the region of said heating member is not confined by said magnetic flux confining member.

28. An image heating apparatus comprising:

a heating member configured to heat a toner image on a recording material;

an excitation coil configured to generate a magnetic flux for electromagnetic induction heating of said heating member;

a magnetic flux confining member configured to suppress the magnetic flux actable on said heating member from said excitation coil;

a motor configured to move said magnetic flux confining member;

a detector configured to detect that said magnetic flux confining member is in a predetermined position; and a controller configured to control an operation of said motor, when said detector detects said magnetic flux confining member after a predetermined time elapses from production of a first instruction for moving said magnetic flux confining member toward the predetermined position, said controller produces a second instruction for moving said magnetic flux confining member in a direction away from the predetermined position.

29. An apparatus according to claim 28, wherein when said detector detects said magnetic flux confining member after a predetermined time elapses from production of the second instruction, said controller produces a third instruction for moving said magnetic flux confining member toward the predetermined position.

30. An apparatus according to claim 29, wherein said controller is configured to alternately produce the second instruction and the third instruction a predetermined number of times, and produces an instruction for notification of an anomaly of said motor if said detector detects said magnetic flux confining member despite the predetermined number of repetitions of productions of the second and third instructions.

31. An apparatus according to claim 30, further comprising a notifying portion configured to perform a notification of an anomaly of said motor in response to the instruction for the notification from said controller.

32. An apparatus according to claim 28, wherein when said detector comes not to detect said shutter before the predetermined time elapses from the production of the second instruction, said controller permits an image heating process operation.

33. An apparatus according to claim 28, wherein said controller produces the second instruction with an output torque of said motor which is larger than an output torque of said motor produced with the first instruction.

34. An apparatus according to claim 28, wherein said controller controls an operation of said motor in accordance with the width of the recording material.

35. An apparatus according to claim 34, wherein when an image heating process is executed for a predetermined recording material having a width which is smaller than a maximum width of a recording material which is capable of being processed by said apparatus, said controller controls said motor so that the magnetic flux actable on a region of said heating member not contacting the predetermined recording material is confined by said magnetic flux confining member, and when the image heating process is executed for the recording material having the maximum width which is capable of being processed by said apparatus, said controller controls said motor so that the magnetic flux actable on a region of said heating member contacting the maximum width recording material is not confined by said magnetic flux confining member.

36. An apparatus according to claim 35, wherein the predetermined position is a position in which the magnetic flux actable on the region of said heating member is not confined by said magnetic flux confining member.

* * * * *